US010176818B2

(12) United States Patent
Liang et al.

(10) Patent No.: US 10,176,818 B2
(45) Date of Patent: Jan. 8, 2019

(54) SOUND PROCESSING USING A PRODUCT-OF-FILTERS MODEL

(71) Applicant: Adobe Systems Incorporated, San Jose, CA (US)

(72) Inventors: Dawen Liang, New York, NY (US); Matthew Douglas Hoffman, San Francisco, CA (US); Gautham J. Mysore, San Francisco, CA (US)

(73) Assignee: Adobe Inc., San Jose, CA (US)

( * ) Notice: Subject to any disclaimer, the term of this patent is extended or adjusted under 35 U.S.C. 154(b) by 636 days.

(21) Appl. No.: 14/081,479

(22) Filed: Nov. 15, 2013

(65) Prior Publication Data

US 2015/0142450 A1 May 21, 2015

(51) Int. Cl.
*G10L 25/75* (2013.01)
*G10L 19/26* (2013.01)
*G10H 1/12* (2006.01)

(52) U.S. Cl.
CPC ..... *G10L 19/26* (2013.01); *G10H 1/125* (2013.01)

(58) Field of Classification Search
CPC ..... G10L 25/75
USPC ..... 704/500
See application file for complete search history.

(56) References Cited

U.S. PATENT DOCUMENTS 5,730,140 A * 3/1998 Fitch ..... A61B 5/0205 600/514
6,151,575 A * 11/2000 Newman ..... G10L 15/07 704/231
6,879,952 B2 * 4/2005 Acero ..... G10L 25/78 381/66
6,990,447 B2 * 1/2006 Attias ..... G10L 21/0208 704/226
7,054,810 B2 * 5/2006 Gao ..... G10L 15/02 704/231
8,738,376 B1 * 5/2014 Goel ..... G10L 15/14 704/205
2004/0260548 A1 * 12/2004 Attias ..... G06K 9/6226 704/236
2005/0065784 A1 * 3/2005 McAulay ..... G10L 19/093 704/205
2007/0154033 A1 * 7/2007 Attias ..... H04R 3/005 381/94.1
2008/0255830 A1 * 10/2008 Rosec ..... G10L 13/033 704/205
2009/0268962 A1 * 10/2009 Fearon ..... G10L 21/028 382/168
2010/0232619 A1 * 9/2010 Uhle ..... G10L 21/0364 381/80

(Continued)

OTHER PUBLICATIONS

Cemgil, Ali T., "Bayesian Inference for Nonnegative Matrix Factorisation Models", *Computational Intelligence and Neuroscience*, 2009., (2009),18 pages.

(Continued)

*Primary Examiner* — Michael N Opsasnick
(74) *Attorney, Agent, or Firm* — Wolfe-SBMC

(57) ABSTRACT

Sound processing using a product-of-filters model is described. In one or more implementations, a model is formed by one or more computing devices for a time frame of sound data as a product of filters. The model is utilized by the one or more computing devices to perform one or more sound processing techniques on the time frame of the sound data.

20 Claims, 8 Drawing Sheets

(56) References Cited

U.S. PATENT DOCUMENTS

| | | | | |
|---|---|---|---|---|
| 2012/0166195 | A1* | 6/2012 | Hayakawa | G10L 17/04 704/240 |
| 2013/0132077 | A1* | 5/2013 | Mysore | G10L 21/028 704/233 |
| 2013/0226558 | A1* | 8/2013 | Mysore | G10L 21/028 704/9 |

OTHER PUBLICATIONS

Hoffman, Matthew D., et al., "Bayesian Nonparametric Matrix Factorization for Recorded Music", *In Proceedings of the 27th Annual International Conference on Machine Learning*, pages, 2010., (2010), 8 pages.

Jordan, Michael I., et al., "An introduction to variational methods for graphical models", *Machine learning*, 37(2):183-233, 1999., (1999), pp. 183-223.

Virtanen, Tuomas et al., "Analysis of polyphonic audio using source-filter model and non-negative matrix factorization", *In Advances in models for acoustic processing, neural information processing systems workshop, Citeseer*, 2006., (2006), 5 pages.

* cited by examiner

600

| | | OVRL | STOI |
|---|---|---|---|
| Band-limited input | | 1.72 (0.16) | 0.762 (0.012) |
| KL-NMF | $K$=25 | 2.60 (0.12) | 0.786 (0.013) |
| | $K$=50 | 2.71 (0.14) | 0.790 (0.013) |
| | $K$=100 | 2.41 (0.10) | 0.759 (0.012) |
| IS-NMF | $K$=25 | 2.43 (0.15) | 0.779 (0.013) |
| | $K$=50 | 2.62 (0.12) | 0.774 (0.014) |
| | $K$=100 | 2.15 (0.10) | 0.751 (0.012) |
| PoF | | **3.25 (0.13)** | **0.804 (0.010)** |

Fig. 6

700

| | MFCC | PoFC | MFCC + PoFC |
|---|---|---|---|
| Frame-level | 49.1% | 60.5% | 65.5% |
| Smoothing | 74.2% | 85.0% | 89.5% |

Fig. 7

SOUND PROCESSING USING A PRODUCT-OF-FILTERS MODEL

BACKGROUND

Sound processing may be performed to achieve a variety of different functionalities. Examples of such functionalities include bandwidth expansion, speaker identification, denoising, and so on.

Conventional approaches to sound processing, however, typically relied on hand-designed decompositions built of basic operations. Examples of such decompositions involve Fourier transforms, discrete cosine transforms, and least-squares solvers. As such, these conventional approaches could be time and labor intensive as well as rely on user generation of the hand-designed decompositions.

SUMMARY

Sound processing using a product-of-filters model is described. In one or more implementations, a model is formed by one or more computing devices for a time frame of sound data as a product of filters. The model is utilized by the one or more computing devices to perform one or more sound processing techniques on the time frame of the sound data.

In one or more implementations, a system includes one or more modules implemented at least partially in hardware, the one or more modules are configured to perform operations including learning filters for a plurality of time frames of sound data using one or more statistical inference techniques. The system also includes at least one module implemented at least partially in hardware, the at least one module configured to perform operations including modeling each of the plurality of time frames as a combination of the learned filters.

In one or more implementations, a dictionary prior is learned by one or more computing devices by forming a model as a combination of filters using one or more statistical inference techniques. The dictionary prior is utilized as a part of nonnegative matrix factorization (NMF) to process sound data by the one or more computing devices.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

FIG. 6 depicts a table showing a composite objective measure and short-time objective intelligibility scores for a bandwidth expansion task.

FIG. 7 depicts a table showing a comparison of speaker identification accuracy.

DETAILED DESCRIPTION

Overview

A product-of-filters (PoF) model is described, which may be configured as a generative model that decomposes audio spectra as sparse linear combinations of filters, e.g., in a log-spectral domain. The product-of-filters model may make similar assumptions to those used in a homomorphic filtering approach to signal processing, but replaces hand-designed decompositions built of basic signal processing operations with a learned decomposition based on statistical inference. Accordingly, unlike previous approaches, these filters are learned from data rather than selected from convenient families such as orthogonal cosines.

The product-of-filters model may also be configured to learn a sparsity-inducing prior that gives preference to decompositions that use relatively few filters to explain each observed spectrum. The result, when applied to speech or other sound data, is that product-of-filters models may be used to learn filters that model a variety of different characteristics of the sound data, such as a filter that models excitation signals and a filter that models the various filtering operations that the vocal tract can perform, for instance.

In the following discussion, generation of a product-of-filters (PoF) model is described which may involve use of a mean-field method for posterior inference and a variational expectation-maximization algorithm to estimate free parameters of the model. Examples of use of the product-of-filters model is then described, such as for a bandwidth expansion task, use as an unsupervised feature extractor for a speaker identification task, use as a dictionary prior for nonnegative matrix factorization (NMF), and so on. The discussion begins with an example environment that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
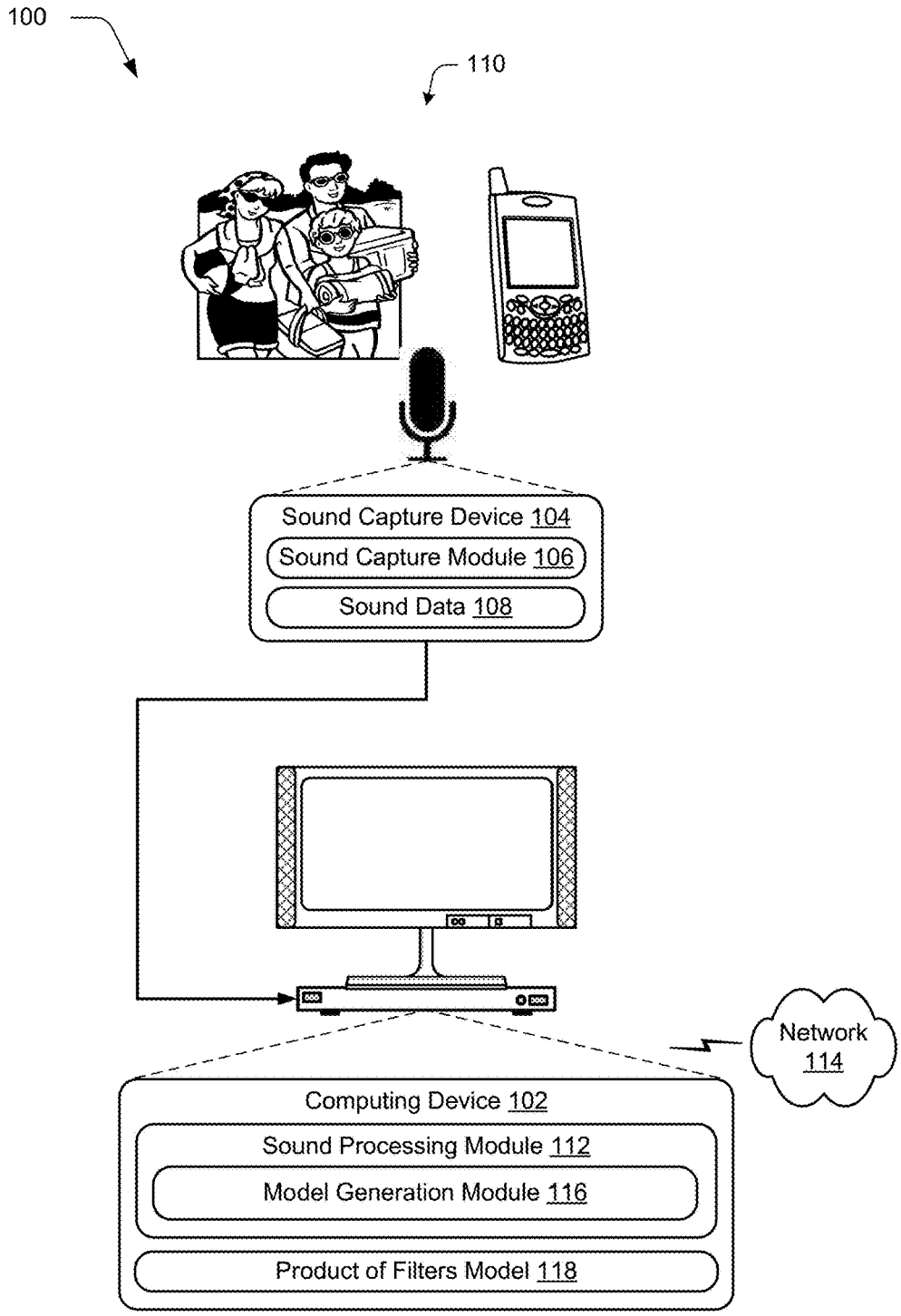
FIG. 1 is an illustration of an environment in an example implementation that is operable to employ techniques described herein.

FIG. 1 is an illustration of an environment 100 in an example implementation that is operable to employ filter techniques described herein. The illustrated environment 100 includes a computing device 102 and sound capture device 104, which may be configured in a variety of ways.

The computing device 102, for instance, may be configured as a desktop computer, a laptop computer, a mobile device (e.g., assuming a handheld configuration such as a tablet or mobile phone), and so forth. Thus, the computing device 102 may range from full resource devices with substantial memory and processor resources (e.g., personal computers, game consoles) to a low-resource device with limited memory and/or processing resources (e.g., mobile devices). Additionally, although a single computing device 102 is shown, the computing device 102 may be representative of a plurality of different devices, such as multiple servers utilized by a business to perform operations "over the cloud" as further described in relation to FIG. 14.

The sound capture device 104 may also be configured in a variety of ways. Illustrated examples of one such configuration involves a standalone device but other configurations are also contemplated, such as part of a mobile phone, video camera, tablet computer, part of a desktop microphone, array microphone, and so on. Additionally, although the sound capture device 104 is illustrated separately from the computing device 102, the sound capture device 104 may be configured as part of the computing device 102, the sound capture device 104 may be representative of a plurality of sound capture devices, and so on.

The sound capture device 104 is illustrated as including respective sound capture module 106 that is representative of functionality to generate sound data 108. The sound capture device 104, for instance, may generate the sound data 108 as a recording of an audio scene 110 having one or more sources. This sound data 108 may then be obtained by the computing device 102 for processing.

The computing device 102 is illustrated as including a sound processing module 112. The sound processing module is representative of functionality to process the sound data 108. Although illustrated as part of the computing device 102, functionality represented by the sound processing module 112 may be further divided, such as to be performed "over the cloud" via a network 114 connection, further discussion of which may be found in relation to FIG. 14.

An example of functionality of the sound processing module 112 is represented as a model generation module 116. The model generation module 116 is representative of functionality to generate a product-of-filters model 118 that may be used as part of sound processing performed by the sound processing module 112. The product-of-filters model 118 be configured based on a statistical analysis that is automatically performed by the model generation module 116 without user intervention. The models may be configured to model a variety of different types of sound data 108, an example of which is described as follows and shown in a corresponding figure.

Figure 2:
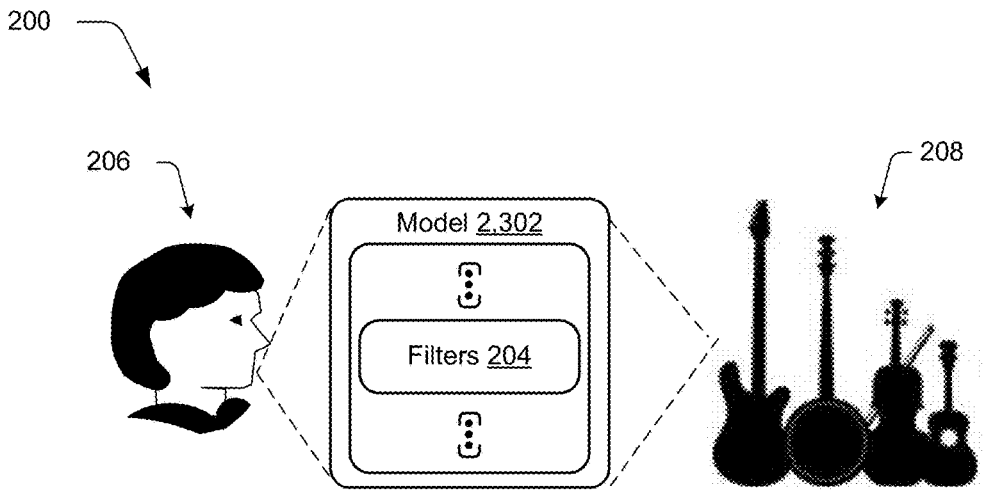
FIG. 2 depicts an example implementation in which a model of sound data is formed as a plurality of filters.

FIG. 2 depicts an example implementation in which a model 202 is formed using a plurality of filters 204. Models 202 may be formed from audio spectrograms, which may be configured as collections of Fourier magnitude spectra "W" taken from a set of audio signals, where "W" is an "F×T" nonnegative matric, and a cell "$W_{ft}$" gives a magnitude of an audio signal at frequency bin "f" and time window (e.g., frame) "t." Each column of "W" is the magnitude of the fast Fourier transform (FFT) of a short window of an audio signal, within which the spectral characteristics of the signal are assumed to be roughly stationary.

The model 202, for instance, may be configured in a manner that leverages homomorphic filtering approaches to audio signal processing, where a short window of audio "w[n]" is modeled as a convolution between an excitation signal "e[n]" (which may originate from a speaker 206's vocal folds) and an impulse response "h[n]" of a series of linear filters (such as might be implemented by a speaker 206's vocal tract) as shown in the following expression:

$$w[n]=(e*h)[n] \tag{1}$$

In the spectral domain after taking the FFT, this may be expressed as:

$$|W[k]|=|\varepsilon[k]|\circ|H[k]|=\exp\{\log|\varepsilon[k]|+\log|H[k]|\} \tag{2}$$

where "○" denotes element-wise multiplication and "|●|" denotes the magnitude of a complex value produced by the FFT. Thus, the convolution between these two signals becomes a simple addition of corresponding log-spectra. Another feature is the symmetry between the excitation signal "e[n]" and the impulse response "h[n]" of the vocal-tract filter. Convolution commutes, so mathematically (if not physiologically) the vocal tract may be exciting the "filter" implemented by vocal folds of the speaker 206.

The observed magnitude spectra may also be modeled as a product of filters. For example, each observed log-spectrum may be assumed as approximately obtained by linearly combining elements from a pool of "L" log filters:

$$U\equiv[u_1|u_2|\ldots|u_L]\in\mathbb{R}^{F\times L}$$

such that:

$$\log W_{ft}\approx\sum_l U_{fl}a_{lt}, \tag{3}$$

where "$a_{lt}$" denotes the activation of filter "$u_l$" in frame "t." Sparsity may be imposed on the activations to encode an intuition that each of the filters is not active at any one time. This assumption expands on the expressive power of the simple excitation-filter model of Equation (1). That model may be recovered by partitioning the filters into "excitations" and "vocal tracts" in which exactly one "excitation filter" is active in each frame. The weighted effects of each of the "vocal tract filters" may then be combined into a single filter.

A classic excitation-filter model may be relaxed to include more than two filters, for computational and statistical reasons. A statistical rationale, for instance, may be that the parameters that define the human voice of the speaker 206 (e.g., pitch, tongue position, and so on) are inherently continuous, and so a large dictionary of excitations and filters may be involved in explaining observed inter- and intra-speaker variability with the classic model. Computational rationale may include a realization that clustering models (which may try to determine which excitation is active) may be more fraught with local optima than factorial models, which try to determine an amount of activation of each filter.

Accordingly, a product-of-filters model may be defined as follows:

$$a_{lt}\sim\text{Gamma}(\alpha_l,\alpha_l) \tag{4}$$

$$W_{ft}\sim\text{Gamma}\left(\gamma_f,\gamma_f/\exp\left(\sum_l U_{fl}a_{lt}\right)\right)$$

where "$\gamma_f$" is the frequency-dependent noise level. Activations "$a_t$" may be restricted to be non-negative, although dictionary elements "$u_l$" are not.

Under this model:

$$\mathbb{E}[a_{lt}] = 1 \tag{5}$$

$$\mathbb{E}[W_{ft}] = \exp\left(\sum_l U_{fl} a_{lt}\right),$$

for $l \in \{1, 2, \ldots, L\}$, $\alpha_l$ controls the sparseness of the activations associated with filter "$u_l$". Smaller values of "$\alpha_l$" indicate that filter "$u_l$" is used more rarely. From a generative point of view, one can view the model as first drawing activations "$a_{tl}$" from a sparse prior, then applying multiplicative gamma noise with expected value "1" to the expected value which is shown as follows:

$$\exp(\Sigma_l U_{fl} a_{lt})$$

Figure 3:
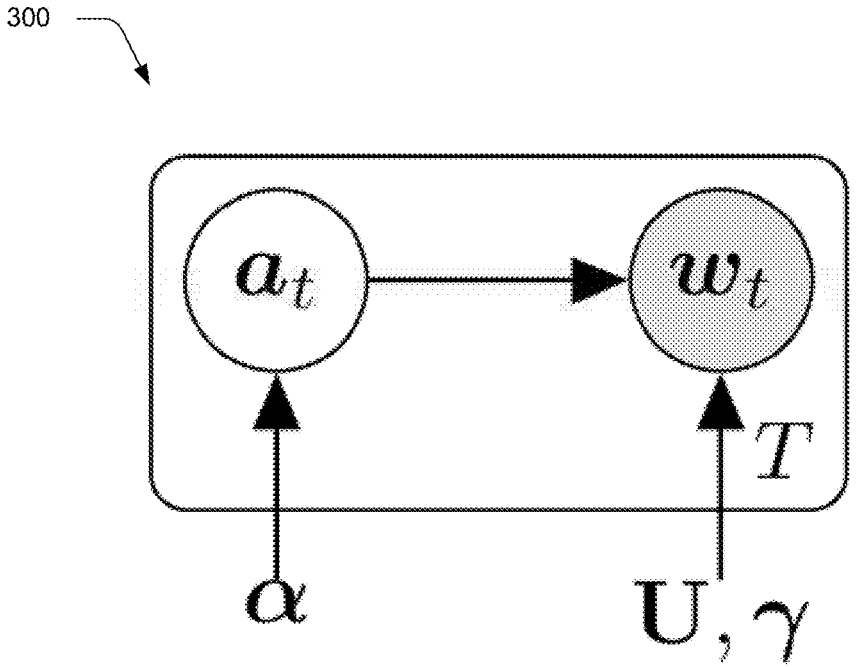
FIG. 3 depicts a graphical model representation of a product-of-filters model.

A graphical model representation of the product-of-filters model is shown in an example 300 in FIG. 3. In the figure, the shaded node represents an observed variable and unshaded nodes represent hidden variables. A directed edge from node "a" to node "b" denotes that the variable "b" depends on the value of variable "a." Plates denote replication by the value in the lower right of the plate.

Although the following discussion focuses on speech applications, the homomorphic filtering approach may be applied to model a wide variety of other types of sounds. This may include modeling of musical instruments 208 of FIG. 2 in which the effect of random excitation, string, and body is modeled as a chain of linear systems, which may therefore be modeled as a product of filters.

As shown in FIG. 3, there are two computational aspects that arise from use of the product-of-filters model. First, given a fixed "U," "α," and "γ" and input spectrum "$w_t$," the posterior distribution "$p(a_t|w_t, U, \alpha, \gamma)$" is computed. This enables the product-of-filters model to be fit to unseen data and to obtain a different representation in the latent filter space. Second, given a collection of training spectra "$W=\{w_t\}^{PT}$" it is desirable to find maximum likelihood estimates of the free parameters "U," "α," and "γ." The following discussion addresses these two problems, with a detailed derivation being provided later in the description.

Posterior Inference Via Mean-Field Technique

The posterior "$p(a_t|w_t, U, \alpha, \gamma)$" is intractable to compute due to the nonconjugacy of the model. Therefore, a mean-field variational inference may be utilized instead. Variational inference is a deterministic alternative to the Monte Carlo Markov Chain (MCMC) methods. The basic idea behind variational inference is to choose a tractable family of variational distributions "$q(a_t)$" to approximate the intractable posterior "$p(a_t|w_t, U, \alpha, \gamma)$" so that the Kullback-Leibler (KL) divergence between the variational distribution and the true posterior "$KL(q_a \| p_{a|}w)$" is minimized. In particular, the mean-field family is completely factorized, i.e., "$q(a_t)=\pi_t q(a_{lt})$." For each "$a_{lt}$" a variational distribution is chosen from the same family as "$a_{lt}$'s" prior distribution:

$$q(a_{tl}) = \text{Gamma}(a_{tl}; \nu_{tl}^a, \rho_{tl}^a)$$

The variational parameters "$\nu_t^a$" and "$\rho_t^a$" are free parameters that may be tuned to minimize the KL divergence between "q" and the posterior.

The marginal likelihood of the input spectrum "$w_t$" may be lower bounded under parameter "U," "α," and "γ":

$$\log p(w_t|U,\alpha,\gamma) \geq \mathbb{E}_q[\log p(w_t, a_t|Y,\alpha,\gamma)] - \mathbb{E}_q[\log q(a_t)] \equiv L(\nu_t^a, \rho_t^a). \tag{6}$$

To compute the variational lower bound "$L(\nu_t^a, \rho_t^a)$" the expectations:

$$\mathbb{E}_q[a_{lt}] = \nu_{lt}^a / \rho_{lt}^a; \text{ and}$$

$$\mathbb{E}_q[\log a_{lt}] = \psi(\nu_{lt}^a) - \log \rho_{lt}^a$$

are computed, where "ψ(•)" is a digamma function. For "$\mathbb{E}_q[\exp(-U_{fl}\ a_{lt})]$" the moment-generating function of gamma distribution is sought and the expectation is obtained as:

$$\mathbb{E}_q[\exp(-U_{fl} a_{lt})] = \left(1 + \frac{U_{fl}}{\rho_{lt}^a}\right)^{-\nu_{lt}^a} \tag{7}$$

for "$U_{fl} > -\rho_{lt}^a$" and "+∞" otherwise.

There is no closed-form update for the variational inference due to the nonconjugacy and the exponents in the likelihood model. Therefore, the gradient of "$L(\nu_t^a, \rho_t^a)$" is computed with respect to variational parameters "$\nu_t^a$" and "$\rho_t^a$" and Limited-memory Broyden-Fletcher-Goldfarb-Shanno (L-BFGS) algorithm is used to optimize the variational lower bound, which guarantees to find a local optimum and optimal variational parameters "$\{\hat{\nu}_t^a, \hat{\rho}_t^a\}$."

Note, that in the posterior inference, the optimization problem is independent for different frame "t." Therefore, given input spectra "$\{w_t\}^{1:T}$", the problem may be broken down into "T" independent sub-problems which may be solved in parallel.

Parameter Estimation

Given a collection of training audio spectra "$\{w_t\}^{1:T}$", parameter estimation for the product-of-filters models may be performed by finding maximum-likelihood estimates of the free parameters "U," "α," and "γ," and approximately marginalizing out "$a_t$."

Formally, the objective for parameter estimation may be defined as:

$$\begin{aligned} \hat{U}, \hat{\alpha}, \hat{\gamma} &= \underset{U,\alpha,\gamma}{\operatorname{argmax}} \sum_t \log p(w_t \mid U, \alpha, \gamma) \\ &= \underset{U,\alpha,\gamma}{\operatorname{argmax}} \sum_t \log \int_{a_t} p(w_t, a_t \mid U, \alpha, \gamma)\, da_t \end{aligned} \tag{8}$$

This problem may be solved using a variational expectation-maximization (EM) algorithm which first maximizes a lower bound on marginal likelihood in Equation (6) with respect to the variational parameters, then, for the fixed values of variational parameters, maximizes the lower bound with respect to the model's free parameters "U," "α," and "γ."

In the expectation step, for each "$w_t$" where "t=1, 2, . . . , T," posterior inference is performed by optimizing values of the variational parameters "$\{\hat{\nu}_t^a, \hat{\rho}_t^a\}$" as described above. For the maximization step, the variational lower bound is maximized in Equation (6), which is equivalent to maximizing the following objective:

$$Q(U, \alpha, \gamma) = \sum_t \mathbb{E}_q[\log p(w_t, a_t \mid U, \alpha, \gamma)] \tag{9}$$

This is accomplished by finding the maximum-likelihood estimates using the expected sufficient statistics that were computed in the expectation step. There is no closed-form update for the maximization step. Therefore, the gradient of "Q(U,α,γ)" is computed with respect to "U," "α," and "γ," respectively, and L-BFGS is used to optimize the bound in Equation (9).

The most time-consuming part for the maximization step is to update "U," which is an "F×L" matrix. Note, however, that the optimization problem is independent for different frequency bins "f∈{1, 2, . . . , F}". Therefore, "U" may be updated by optimizing each row independently, and in parallel if desired.

Variational EM for Product-of-Filters Model

Expectation Step

To obtain the variational lower bound for the E-step shown above, assume the variational distribution is "$q(a_t)=\pi_t q(a_{lt})=\pi_t \text{Gamma}(a_{lt};\ \nu_{lt}^a;\ \rho_{lt}^a)$" and make use of the Jensen's inequality as follows:

$$\begin{aligned}\log p(W \mid U, \alpha, \gamma) &= \sum_t \log p(w_t \mid U, \alpha, \gamma)\\ &= \sum_t \log \int_{a_t} q(a_t)\frac{p(w_t, a_t \mid U, \alpha, \gamma)}{q(a_t)}\,da_t\\ &\geq \sum_t \int_{a_t} q(a_t)\log\frac{p(w_t, a_t \mid U, \alpha, \gamma)}{q(a_t)}\,da_t\\ &= \sum_t \mathbb{E}_q[\log p(w_t, a_t \mid U, \alpha, \gamma)] - \mathbb{E}_q[\log q(a_t)]\\ &\equiv \sum_t \mathcal{L}(\nu_t^a, \rho_t^a)\end{aligned}$$

where $$\begin{aligned}\mathbb{E}_q[\log p(w_t, a_t \mid U, \alpha, \gamma)] &= \mathbb{E}_q[\log p(w_t \mid a_t, U, \gamma)] + \mathbb{E}_q[\log p(a_t \mid \alpha)] \propto\\ &\sum_l \{(\alpha_l - 1)\mathbb{E}_q[\log a_{lt}] - \alpha_l \mathbb{E}_q[a_{lt}]\} -\\ &\sum_f \gamma_f\left\{W_{ft}\prod_l \mathbb{E}_q[\exp(-U_{fl}a_{lt})] + \sum_l U_{fl}\mathbb{E}_q[a_{lt}]\right\}\end{aligned}$$

The value "$\mathbb{E}[\log q(a_t)]=\Sigma_l \nu_{lt}^a - \log \rho_{lt}^a + \log \Gamma(\nu_{lt}^a) + (1-\nu_{lt}^a)\psi(\nu_{lt}^a)$" is the entropy of a gamma distributed random variable.

The derivative of "$L(\nu_t^a, \rho_t^a)$" is then taken with respect to "$\nu_{lt}^a$" and "$\rho_{lt}^a$":

$$\frac{\partial \mathcal{L}}{\partial \nu_{lt}^a} = \sum_f \gamma_f\left\{W_{fl}\log\left(1 + \frac{U_{fl}}{\rho_{lt}^a}\right)\prod_{j=1}^{L}\mathbb{E}_q[\exp(-U_{fj}a_{jt})] - \frac{U_{fl}}{\rho_{lt}^a}\right\} + (\alpha_l - \nu_{lt}^a)\psi_l(\nu_{lt}^a) + 1 - \frac{\alpha_l}{\rho_{lt}^a}$$

$$\frac{\partial \mathcal{L}}{\partial \rho_{lt}^a} = \frac{\nu_{lt}}{(\rho_{lt}^a)^2}\sum_f \gamma_f\left\{-W_{fl}\left(1 + \frac{U_{fl}}{\rho_{lt}^a}\right)^{-1} U_{fl}\prod_{i=1}^{L}\mathbb{E}_q[\exp(-U_{fj}a_{jt})] + U_{fl}\right\} + \alpha_l\left(\frac{\nu_{lt}}{(\rho_{lt}^a)^2} - \frac{1}{\rho_{lt}^a}\right)$$

Maximization Step

The objective function for M-step is:

$$Q(U, \alpha, \gamma) = \sum_t \mathbb{E}_q[\log p(w_t, a_t \mid U, \alpha, \gamma)]$$

-continued $$= \sum_t\left\{\sum_f\left(\gamma_f \log\gamma_f - \gamma_f\sum_l U_{fl}\mathbb{E}_q[a_{lt}] - \log\Gamma(\gamma_f) + (\gamma_f - 1)\log W_{ft} - W_{ft}\gamma_f\prod_l \mathbb{E}_q[\exp(-U_{fl}a_{lt}) + \sum_l (\alpha_l\log\alpha_l - \log\Gamma(\alpha_l) + (\alpha_l - 1)\mathbb{E}_q[\log a_{lt}] - \alpha_l\mathbb{E}_q[a_{lt}])\right\}$$

Taking the derivative with respect to "U, α,γ," the following gradients are obtained:

$$\frac{\partial Q}{\partial U_{fl}} = \sum_t (-\mathbb{E}_q[a_{lt}] + W_{ft}\mathbb{E}_q[a_{lt}])\left(1 + \frac{U_{fl}}{\rho_{lt}^a}\right)^{-(\nu_{lt}^a+1)}\prod_{j\neq l}\mathbb{E}_q[\exp(-U_{fl}a_{jt})])$$

$$\frac{\partial Q}{\partial \alpha_l} = \sum_t (\log\alpha_l + 1 - \psi(\alpha_l) + \mathbb{E}_q[\log a_{lt}] - \mathbb{E}_q[a_{lt}])$$

$$\frac{\partial Q}{\partial \gamma_f} = \sum_t\left(\log\gamma_f - \sum_l U_{fl}\mathbb{E}_q[a_{lt}] + 1 - \psi(\gamma_f) + \log W_{ft} - W_{ft}\prod_l \mathbb{E}_q[\exp(-U_{fl}a_{lt})]\right)$$

Example Uses of the Product-of-Filters Model

The following describes examples of use of the product-of-filters model on different sound processing tasks. First, use of the model is evaluated to infer missing data in a bandwidth expansion task. Second, use the product-of-filters model is explored as an unsupervised feature extractor for the speaker identification task. Other examples follow, including use of the product-of-filters model as a prior as part of nonnegative matrix factorization.

Both bandwidth expansion and feature extractor tasks involve use of pre-trained parameters "U," "α," and "γ," which were learned from the TIMIT Speech Corpus, e.g., Fisher, W. M., Doddington, G. R., and Goudie-Marshall, K. M. The DARPA speech recognition research database: specifications and status. In Proc. DARPA Workshop on speech recognition, pp. 93-99, 1986 in this example. The corpus contains speech sampled at 16000 Hz from 630 speakers of eight major dialects of American English, each reading ten phonetically rich sentences. The parameters in this example are learned from 20 randomly selected speakers (ten males and ten females). A 1024-point FFT with Hann window and fifty percent overlap is performed, thus the number of frequency bins is "F=513." The examples involve use of magnitude spectrograms except where specified otherwise.

Different model orders "L∈{10, 20, . . . 50}" are utilized in this example and the lower bound on the marginal likelihood "log $p(w_t|U,\alpha,\gamma)$" in Equation (6) is evaluated. In general, larger values of "L" give a larger variational lower bound. However, due to the computational cost, a product-of-filters model was not utilized with a value of "L" larger than fifty in this example as a compromise between performance and computational efficiency. Variational expectation-maximization is performed in this example until the variational lower bound increased by less than 0.01%.

Figure 4:
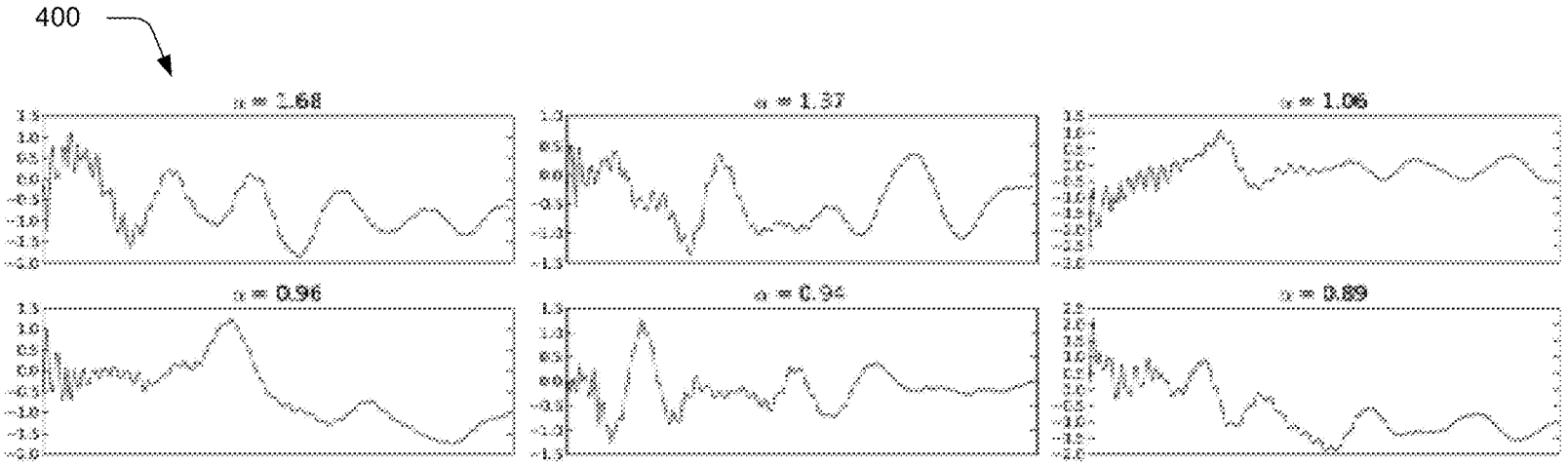
FIGS. 4 and 5 depict graphical examples of filters.
Figure 5:
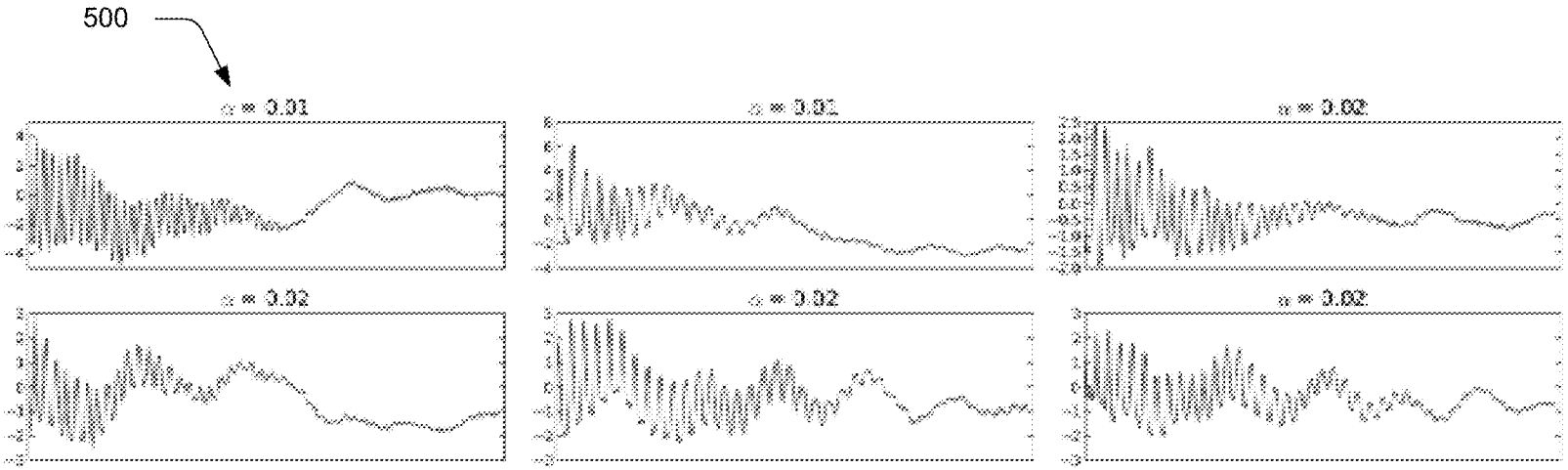

The six filters "$u_l$" associated with the largest values of "$\alpha_l$" are shown in the example 400 of FIG. 4 and the six filters associated with the smallest values of "$\alpha_l$" are shown in the example 500 in FIG. 5. Small values of "$\alpha_l$" indicate a prior preference to use the associated filters less frequently, since the "Gamma($\alpha_l$, $\alpha_l$)" prior places more mass near zero when "$\alpha_l$" is smaller. The filters in FIG. 5, which are used relatively rarely, tend to have the strong harmonic structure displayed by the log-spectra of periodic signals, while the filters in FIG. 4 tend to vary more smoothly, suggesting that the filters are being used to model the filtering induced by the vocal tract.

The periodic "excitation" filters tend to be used more rarely in this example, which is consistent with the intuition that normally there is not more than one excitation signal contributing to a speaker's voice as few people can speak or sing more than one pitch simultaneously. The model has the freedom to use several of the coarser "vocal tract" filters per spectrum, which is consistent with the intuition that several aspects of the vocal tract may be combined to filter the excitation signal generated by a speaker's vocal folds.

Bandwidth Expansion

In this example, a product-of-filters model is utilized in sound processing applications that involve bandwidth expansion which involves inferring the content of a full-bandwidth signal given the content of a band-limited version of that signal. Bandwidth expansion, for instance, may be used to restore low-quality audio such as might be recorded from a telephone or cheap microphone.

Given the parameters "U," "α," and "γ" learned from full-bandwidth training data, the bandwidth expansion problem may be treated as a missing data problem. Given spectra from a band-limited recording "$W^{bl}=\{w_t^{bl}\}_f^{1:T}$" the model implies a posterior distribution "$p(a|W^{bl})$" over the activations "a" associated with the band-limited signal. This posterior may be approximated using the variational inference algorithm previously described. The full bandwidth spectra may then be reconstructed by combining the inferred "$\{a_t\}^{1:t}$" with the full-bandwidth "U." Following the model formulation in Equation (4), the full-bandwidth spectra may be estimated using:

$$\mathbb{E}_q\left[W_{ft}^{fb}\right] = \prod_l \mathbb{E}_q[\exp(U_{fl}a_{lt})] \tag{10}$$

or $$\mathbb{E}_q\left[W_{ft}^{fb}\right] = \exp\left\{\sum_l U_{fl} \cdot \mathbb{E}_q[a_{lt}]\right\}. \tag{11}$$

In this example, Equation (11) is utilized as it has increased stability and because human auditory perception is logarithmic. Accordingly, if the posterior distribution is summarized with a point estimate, the expectation on the log-spectral domain is perceptually natural.

As a comparison, NMF may also be used for bandwidth expansion. The full-bandwidth training spectra "$W_{train}$," which are also used to learn the parameters "U," "α," and "γ" for the product-of-filters model, are decomposed by NMF as "$W^{train}\approx VH$," where "V" is the dictionary and "H" is the activation. Then given the band-limited spectra "$W^{bl}$," the band-limited part of "V" may be used to infer the activation "$H^{bl}$." Finally, the full-bandwidth spectra may be reconstructed by computing "$VH^{bl}$."

Based on how the loss function is defined, there can be different types of NMF models: KL-NMF (Lee, D. D. and Seung, H. S. Algorithms for non-negative matrix factorization. Advances in Neural Information Processing Systems, 13:446-462, 2001) which is based on Kullback-Leibler divergence, and IS-NMF (Fevotte, C., Bertin, N., and Durrieu, J. L. Nonnegative matrix factorization with the Itakura-Saito divergence with application to music analysis. Neural Computation, 21(3):793-830, March 2009) which is based on Itakura-Saito divergence, are among the most commonly used NMF decomposition models in audio signal processing. The product-of-filters model is compared in this example with both KL-NMF and IS-NMF with different model orders K=25, 50, and 100. Standard multiplicative updates are used for NMF and the iterations are stopped when the decrease in the cost function is less than 0.01%. For IS-NMF, power spectra are used instead of magnitude spectra, since the power spectrum representation is more consistent with the statistical assumptions that underlie the Itakura-Saito divergence.

Ten speakers (5 males and 5 females) are randomly selected from TIMIT that do not overlap with the speakers used to fit the model parameters "U," "α," and "γ" and three sentences are taken from each speaker as test data. The content below 400 Hz and above 3400 Hz is excluded to obtain band-limited recordings of approximately telephone-quality speech.

To evaluate the quality of the reconstructed recordings, composite objective measure and short-time objective intelligibility metrics are used in this example. These metrics measure different aspects of the "distance" between the reconstructed speech and the original speech. The composite objective measure (abbreviated as OVRL, as it reflects the overall sound quality) as shown in the table 600 of FIG. 6 may be used as a quality measure for speech enhancement. This technique aggregates different basic objective measures and has been shown to correlate with humans' perceptions of audio quality. OVRL is based on the predicted perceptual auditory rating and is in the range of 1 to 5, e.g., 1: bad; 2: poor; 3: fair; 4: good; 5: excellent.

The short time objective intelligibility measure (STOI) of table 600 of FIG. 6 is a function of the clean speech and reconstructed speech, which correlates with the intelligibility of the reconstructed speech, that is, it predicts the ability of listeners to understand what words are being spoken rather than perceived sound quality. STOI is computed as the average correlation coefficient from fifteen one-third octave bands across frames, thus theoretically should be in the range of −1 to 1, where larger values indicate higher expected intelligibility.

The average OVRL and STOI with two standard errors across thirty sentences for different methods, along with these from the band-limited input speech as baseline, are reported in FIG. 6. As shown in the figure, NMF improves STOI a bit where a product-of-filters model provided additional improvement, but the improvement in both cases is fairly small. This may be because the band-limited input speech already has a relatively high STOI (telephone-quality speech is fairly intelligible). On the other hand, it is readily apparent that the product-of-filters model produces better predicted perceived sound quality as measured by OVRL than KL-NMF and IS-NMF by a large margin, regardless of the model order K.

Feature Learning and Speaker Identification

Use of a product-of-filters model is described in this example as an unsupervised feature extractor. One way to interpret the product-of-filters model is that it attempts to represent the data in a latent filter space. Therefore, given spectra "$\{w_t\}^{1:T}$", the coordinates in the latent filter space "$\{a_t\}^{1:T}$" may be used as features (which will be abbreviated as PoFC).

The learned representation is compared in this example with Mel frequency Cepstral coefficients (MFCCs), which are used in various speech and audio processing tasks including speaker identification. MFCCs are computed by taking the discrete cosine transform (DCT) on Mel-scale log spectra and using the low-order coefficients, solely. The product-of-filters models may be understood in similar terms in trying to explain the variability in log-spectra in terms of a linear combination of dictionary elements. However, instead of using the fixed, orthogonal DCT basis, product-of-filters model learns a filter space that is tuned to the statistics of the input.

Speaker identification is evaluated under the following scenario to identify different speakers from a meeting recording, given a small amount of labeled speech for each speaker. Ten speakers (five males and five females) are randomly selected from TIMIT outside the training data used to learn the free parameters "U," "α," and "γ." The first thirteen DCT coefficients are used.

The PoFC is calculated using posterior inference as described above and used "$\mathbb{E}_q[a_t]$" as a point estimate summary. For both MFCC and PoFC, the first-order and second-order differences are computed and concatenated with the original feature.

The speaker identification problem may be addressed as a classification problem in which predictions are made for each frame. Eight sentences are trained from each speaker and tested with the remaining two sentences, which involves 7800 frames of training data and 1700 frames of test data in this example. The test data is randomly permuted so that the order in which sentences appear is random.

The frame level accuracy is reported in the first row of the table 700 of FIG. 7. As shown in the figure, PoFC increases the accuracy by a relatively large margin, e.g., from 49.1% to 60.5%. To make use of temporal information, a simple median filter smoother with a length of twenty-five is used, which boosts the performance for both representations equally. These results are reported in the second row of the table 700.

Although MFCCs and PoFCs capture similar information, concatenating both sets of features yields greater accuracy than that obtained by either feature set alone. The results achieved by combining the features are summarized in the last column of table 600, which indicates that MFCCs and PoFCs capture complementary information. These results, which use a relatively simple frame-level classifier, suggest that PoFC could produce even greater accuracy when used in a model having increased sophistication.

In the above, a product-of-filters (PoF) model is described which may involve a generative model that makes similar assumptions to those used in the classic homomorphic filtering approach to the signal processing. The inference and parameter estimation algorithm is implemented via a variational method. Further, examples of improvements that may be realized are described that involve a bandwidth expansion task and showed that the product-of-filters model may serve as an effective unsupervised feature extractor for speaker identification.

Although the product-of-filters model was described as a standalone model, it may also be used as a building block and integrated into a bigger model, e.g., as a prior for the dictionary in a probabilistic NMF model as further described below in the following section.

Learned Product-of-Filters Dictionary Prior

Many sound processing techniques involve use of a learned "dictionary" from sound data to provide a compact presentation of the individual sound. In this section, a product-of-filters dictionary prior is described which is inspired by the classic homomorphic filtering approach to the signal processing. Through design of the probabilistic model, the prior can be used as a "plug-in" to seamlessly fit into probabilistic nonnegative matrix factorization frameworks, yet provides additional modeling power.

Nonnegative matrix factorization (NMF) has been extensively applied to analyze audio signals. NMF approximately decomposes an audio spectrogram into the product of dictionary and activation, which can be broadly understood as breaking mixed audio signals (e.g., mixtures of speech and noise) into individual acoustic events and an indication of when they are active. In the following, a product-of-filters prior is described. The described prior model may be used as a stand-alone model as described earlier or be incorporated into the NMF framework as the prior for dictionary.

Full NFM Model with Product-of-Filters Dictionary Prior

A product-of-filters dictionary prior is used to learn a "meta-dictionary" which will generate the dictionary in the way similar to how clean sound is generated via a source-filter model, which interprets clean sound as a "source", which mostly determines pitch, and applying to a "filter", which mostly determines timbral quality. A difference between a dictionary prior described herein and a conventional actual source-filter model is that a one-to-one mapping is not constrained between sources and filters. Sources and filters are not explicitly distinguished in this example and rather are treated interchangeably. Therefore, sources and filters may together serve as a meta-dictionary and thus "filters" will be used to refer to the components in a meta-dictionary for the following discussion. An approach taken in the following to address this prior modeling problem involves use of the product-of-filters model as a reasonable way to formulate the underlying generative process from a probabilistic perspective. Since the prior serves as a general way to model sound, there can be many potential applications that may benefit from this modeling scheme.

The following notational conventions are adopted in the following, including that upper case bold letters (e.g. W, H, and U) denote matrices and lower case bold letters (e.g. w, a, γ, and α) denote vectors. An expression "$f \in \{1, 2, \ldots, F\}$" is used to index frequency. The expression "$t \in \{1, 2, \ldots, T\}$" is used to index time. The expression "$l \in \{1, 2, \ldots, L\}$" is used to index meta-dictionary components (filters) and "$k \in \{1, 2, \ldots, K\}$" is used to index dictionary components (in NMF model).

Full NMF Model with Product-of-Filters Dictionary Prior

Figure 8:
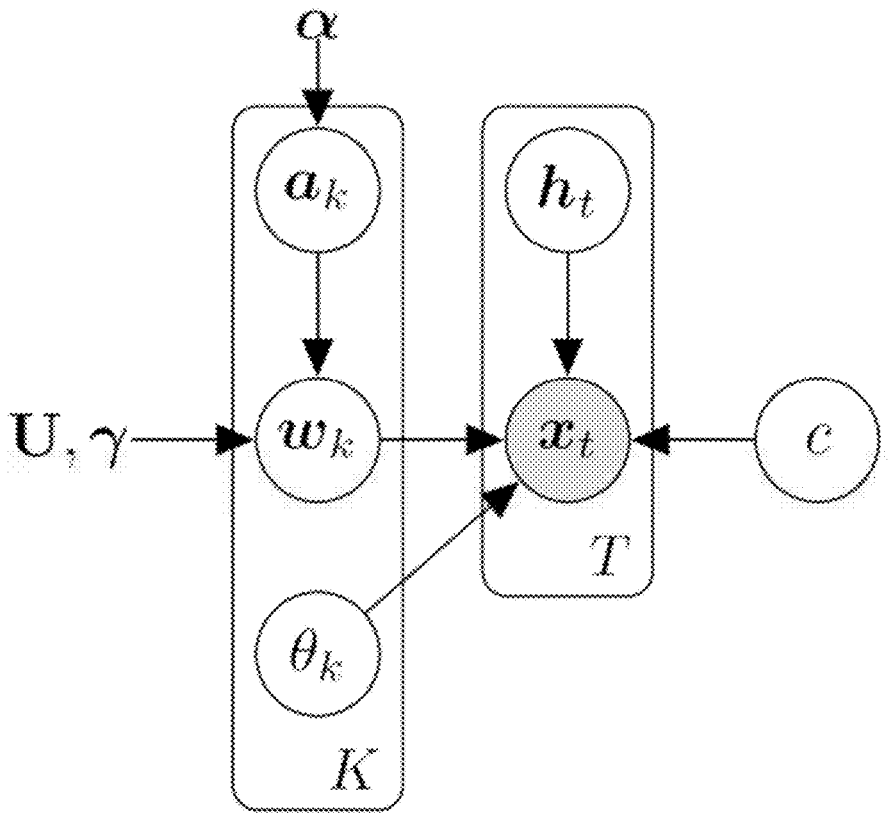
FIG. 8 depicts a graphical model representation of a product-of-filters prior in a nonnegative matrix factorization model.

Once the model parameters of product-of-filters prior U, α and γ are learned from the data with reasonably wide variety, the prior may act as a "plug-in" to naturally fit into a probabilistic NMF model. An example 800 of this is shown in FIG. 8 as a version of a gamma process NMF (GaP-NMF) that utilized a product-of-filters dictionary prior. Other examples are also contemplated, such as a KL-divergence loss function under a probabilistic setting. The prior "U, α,γ" is incorporated into the model in the example 800 as follows:

$$a_{lk} \sim \text{Gamma}(\alpha_l, \alpha_l)$$

$$W_{fk} \sim \text{Gamma}\left(\gamma_f, \gamma_f / \exp\left(\sum_l U_{fl} a_{lk}\right)\right)$$

-continued $$H_{kt} \sim \text{Gamma}(b, b)$$

$$\theta_k \sim \text{Gamma}(\beta / K, \beta)$$

$$X_{ft} \sim \text{Exp}\left(c \sum_k \theta_k W_{fk} H_{kt}\right)$$

The tractable variational distributions are:

$$q(a_{lk}) = \text{Gamma}(\nu_{lk}^a, \rho_{lk}^a)$$

$$q(W_{fk}) = GIG(\nu_{fk}^W, \rho_{fk}^W, \tau_{fk}^W)$$

$$q(H_{kt}) = GIG(\nu_{kt}^H, \rho_{kt}^H, \tau_{kt}^H)$$

$$q(\theta_k) = GIG(\nu_k^\theta, \rho_k^\theta, \tau_k^\theta)$$

The Evidence Lower Bound (ELBO):

$$\log p(X \mid \beta, b) \geq \mathbb{E}_q[\log p(X)] + \mathbb{E}_q\left[\log \frac{p(W)}{q(W)}\right] + \mathbb{E}_q\left[\log \frac{p(H)}{q(H)}\right] + \mathbb{E}_q\left[\log \frac{p(\theta)}{q(\theta)}\right] + \sum_k \mathbb{E}_q\left[\log \frac{p(a_k)}{q(a_k)}\right]$$

Following the lower bounding of the original GaP-NMF, "$\mathbb{E}_q$ [log p(X)]," which is intractable to compute, can be further lower bounded as:

$$\mathbb{E}_q[\log p(X)] = \sum_{f,t} \mathbb{E}_q\left[\frac{-X_{ft}}{c \sum_k \theta_k W_{fk} H_{kt}}\right] - \mathbb{E}_q\left[\log c \sum_k \theta_k W_{fk} H_{kt}\right]$$

$$\geq \sum_{f,t} -\frac{X_{ft}}{c} \sum_k \phi_{kft}^2 \mathbb{E}_q\left[\frac{1}{\theta_k W_{fk} H_{kt}}\right] - \log c - \log(\omega_{ft}) + 1 - \frac{1}{\omega_{ft}} \sum_k \mathbb{E}_q[\theta_k W_{fk} H_{kt}]$$

where for "$\forall\{f,t\}, \phi_{kft} \geq 0$" and "$\Sigma_k \phi_{kft} = 1$." To tighten this bound, the optimal "$\phi_{kft}$" (by using Lagrange multipliers) and "$\phi w_{ft}$" are:

$$\phi_{kft} \propto \mathbb{E}_q\left[\frac{1}{\theta_k W_{fk} H_{kt}}\right]^{-1}$$

$$\omega_{ft} = \sum_k \mathbb{E}_q[\theta_k W_{fk} H_{kt}]$$

Update for "$H_{kt}$":

$$\nu_{kt}^H = b$$

$$\rho_{kt}^H = b + \mathbb{E}_q[\theta_k] \sum_t \frac{\mathbb{E}_q[W_{fk}]}{\omega_{ft}}$$

$$\tau_{kt}^H = \mathbb{E}_q\left[\frac{1}{\theta_k}\right] \sum_f \frac{X_{ft}}{c} \theta_{kft}^2 \mathbb{E}_q\left[\frac{1}{W_{fk}}\right]$$

Update for "$\theta_k$":

$$\nu_k^\theta = \beta / K$$

$$\rho_k^\theta = \beta + \sum_{f,t} \frac{\mathbb{E}_q[W_{fk} H_{kt}]}{\omega_{ft}}$$

-continued $$\tau_k^\theta = \sum_{f,t} \frac{X_{ft}}{c} \phi_{kft}^2 \mathbb{E}_q\left[\frac{1}{W_{fk} H_{kt}}\right]$$

Update for $W_{fk}$:

$$\nu_{fk}^W = \gamma_f$$

$$\rho_{fk}^W = \gamma_f \prod_l \mathbb{E}_q[\exp(-U_{fl} a_{lk})] + \mathbb{E}_q[\theta_k] \sum_t \frac{\mathbb{E}_q[H_{kt}]}{\omega_{ft}}$$

$$\tau_{fk}^W = \mathbb{E}_q\left[\frac{1}{\theta_k}\right] \sum_t \frac{X_{ft}}{c} \phi_{kft}^2 \mathbb{E}_q\left[\frac{1}{H_{kt}}\right]$$

where the optimal scale is expressed as follows:

$$c = \frac{1}{FT} \sum_{f,t} X_{ft} \left( \sum_k \mathbb{E}_q\left[\frac{1}{\theta_k W_{fk} H_{kt}}\right]^{-1} \right)^{-1}$$

As for updating "$a_{lk}$," the same approach as the E-step in the product-of-filters parameter estimation part may be taken. The objective to be maximized:

$$\mathcal{L}_k = const + \sum_l \{(\alpha_l - \nu_{lk}^a)\mathbb{E}_q[\log a_{lk}] - (\alpha_l - \rho_{lk}^a)\mathbb{E}_q[a_{lk}] + A^\Gamma(\nu_{lk}^a, \rho_{lk}^a)\} + \sum_f \gamma_f \left\{ -\mathbb{E}_q[W_{fk}] \prod_l \mathbb{E}_q[\exp(-U_{fl} a_{lk})] - \sum_l U_{fl} \mathbb{E}_q[a_{lk}] \right\}$$

where "$A^\Gamma(\nu_{lk}^a, \rho_{lk}^a) = \log(\nu_{lk}^a) - \nu_{lk}^a \log \rho_{lk}^a$" is the log-normalizer for gamma distribution. The derivative of "$L_k$" is taken with respect to "$\nu_{lk}^a$" and "$\rho_{lk}^a$," then the optimization problem is solved by gradient-based method (L-BFGS).

$$\frac{\partial \mathcal{L}_k}{\partial \nu_{lk}^a} = \sum_f \gamma_f \left\{ \mathbb{E}_q[W_{fk}] \log\left(1 + \frac{U_{fl}}{\rho_{lk}^a}\right) \prod_{j=1}^{L} \mathbb{E}_q[\exp(-U_{fj} a_{jk})] - \frac{U_{fl}}{\rho_{lk}^a} \right\} + (a_l - \nu_{lk}^a)\psi_1(\nu_{lk}^a) + 1 - \frac{a_l}{\rho_{lk}^a}$$

$$\frac{\partial \mathcal{L}_k}{\partial \rho_{lk}^a} = \frac{\nu_{lk}^a}{(\rho_{lk}^a)^2} \sum_f \gamma_f \left\{ -\mathbb{E}_q[W_{fk}] \left(1 + \frac{U_{fl}}{\rho_{lk}^a}\right)^{-1} U_{fl} \prod_{j=1}^{L} \mathbb{E}_q[\exp(-U_{fj} a_{jk})] + U_{fl} \right\} + \alpha_l \left( \frac{\nu_{lk}^a}{(\rho_{lk}^a)^2} - \frac{1}{\rho_{lk}^a} \right)$$

Note update equations are essentially the same with the E-step in the product-of-filters parameter estimation part.

Standard Distributions

Gamma Distributions

If a random variable "x" follows a Gamma distribution with parameters shape "a" and rate "b," the probability density function (PDF) is:

$$\text{Gamma}(x; a, b) = \exp((a-1)\log x - bx - \log \Gamma(a) + a \log b)$$

for "a>0,b>0." A few of the expectations used in the model may be computed as follows:

$$\mathbb{E}[x] = \frac{a}{b}$$

$$\mathbb{E}[\exp(cx)] = \left(1 - \frac{c}{b}\right)^{-a} \text{ if } b > c, +\infty \text{ otherwise.}$$

$$\mathbb{E}[\log x] = \psi(a) - \log b$$

where "Γ(•)" represents and gamma function and "ψ(•)" represents the digamma function.

Generalized Inverse-Gaussian (GIG) Distributions

If a random variable "x" follows a GIG distribution, the probability density function (PDF) is:

$$GIG(x; \nu, \rho, \tau) = \frac{\exp\{(\nu - 1)\log x - \rho x - \tau / x\}\rho^{\nu/2}}{2\tau^{\nu/2}\kappa_\nu\left(2\sqrt{\rho\tau}\right)}$$

for "ν≥0," "ρ≥0," and "τ≥0." "$K_\nu(x)$" denotes the modified Bessel function of the second kind. A few expectations used in the model can be computed as follows:

$$\mathbb{E}[x] = \frac{\kappa_{\nu+1}\left(2\sqrt{\rho\tau}\right)\sqrt{\tau}}{\kappa_\nu\left(2\sqrt{\rho\tau}\right)\sqrt{\rho}}$$

$$\mathbb{E}\left[\frac{1}{x}\right] = \frac{\kappa_{\nu-1}\left(2\sqrt{\rho\tau}\right)\sqrt{\rho}}{\kappa_\nu\left(2\sqrt{\rho\tau}\right)\sqrt{\tau}}$$

Product-of-filters dictionary prior can be used as a "plug-in" within the existing probabilistic NMF frameworks. Thus, it is natural to extend each of the current NMF applications (e.g. source separation, denoising, and de-reverberation) to incorporate the proposed prior.

Example Procedures

The following discussion describes product-of-filters techniques that may be implemented utilizing the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to FIGS. 1-8.

Figure 9:
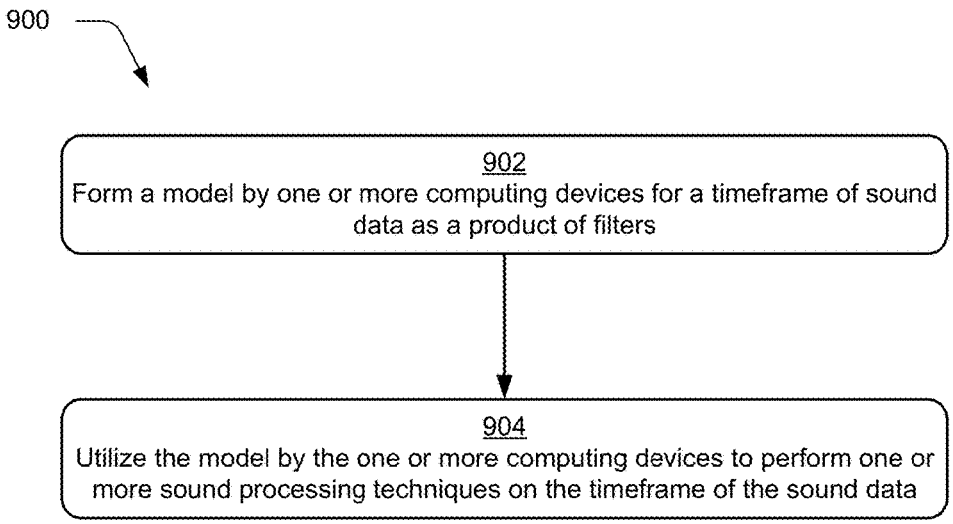
FIG. 9 is a flow diagram depicting a procedure in an example implementation in which a product-of-filters model is used in sound processing.

FIG. 9 depicts a procedure 900 in an example implementation in which a product-of-filters model is used in sound processing. A model is formed by one or more computing devices for a time frame of sound data as a product of filters (block 902). The model, for instance, may be formed using a mean-field method and a variational expectation-maximization algorithm to estimate free parameters of the model. In this way, statistical inference techniques may be applied by a computing device automatically and without user intervention.

The model is utilized by the one or more computing devices to perform one or more sound processing techniques on the time frame of the sound data (block 904). A variety of different sound processing techniques may be performed, such as bandwidth expansion, speaker identification, noise removal, dereverberation, and so on.

Figure 10:
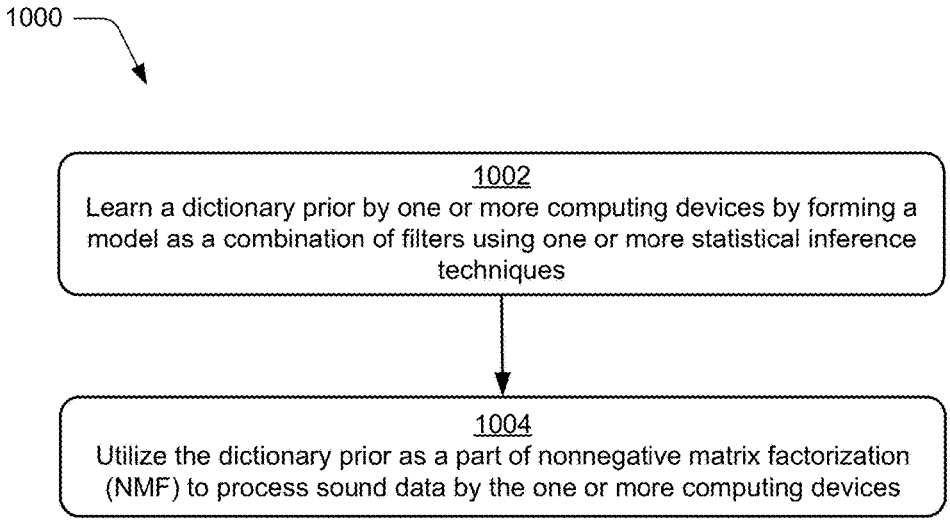
FIG. 10 is a flow diagram depicting a procedure in an example implementation in which a product-of-filters model is used in conjunction with nonnegative matrix factorization as a dictionary prior.

FIG. 10 depicts a procedure 1000 in an example implementation in which a product-of-filters model is used in conjunction with nonnegative matrix factorization as a dictionary prior. A dictionary prior is learned by one or more computing devices by forming a model as a combination of filters using one or more statistical inference techniques (block 1002). As described above, the statistical inference techniques may be performed on the data itself and thus avoid conventional reliance on hand-build decompositions such as Fourier transforms, discrete cosine transforms, and least-squares solvers.

The dictionary prior is utilized as a part of nonnegative matrix factorization (NMF) to process sound data by the one or more computing devices (block 1004). In this way, the dictionary prior may be plugged-in seamlessly into a probabilistic nonnegative matrix factorization framework to provide additional modeling functionality. As described above, this may be utilized to support a wide range of sound processing, such as noise reduction, de-reverberation, and so on.

Example System And Device

Figure 11:
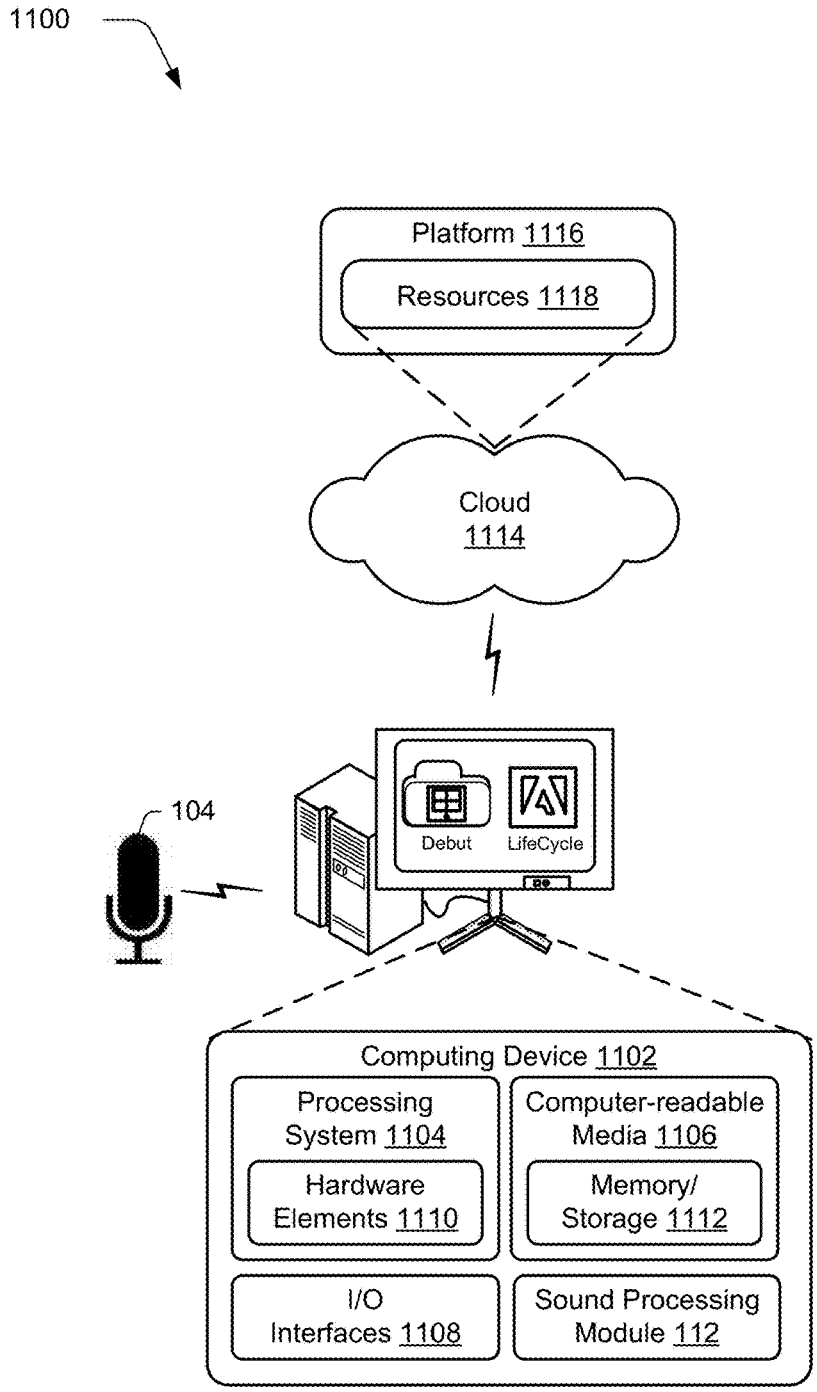
FIG. 11 illustrates an example system including various components of an example device that can be implemented as any type of computing device as described and/or utilize with reference to FIGS. 1-10 to implement embodiments of the techniques described herein.

FIG. 11 illustrates an example system generally at 1100 that includes an example computing device 1102 that is representative of one or more computing systems and/or devices that may implement the various techniques described herein. This is illustrated through inclusion of the sound processing module 112, which may be configured to process sound data, such as sound data captured by an sound capture device 104. The computing device 1102 may be, for example, a server of a service provider, a device associated with a client (e.g., a client device), an on-chip system, and/or any other suitable computing device or computing system.

The example computing device 1102 as illustrated includes a processing system 1104, one or more computer-readable media 1106, and one or more I/O interface 1108 that are communicatively coupled, one to another. Although not shown, the computing device 1102 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 1104 is representative of functionality to perform one or more operations using hardware. Accordingly, the processing system 1104 is illustrated as including hardware element 1110 that may be configured as processors, functional blocks, and so forth. This may include implementation in hardware as an application specific integrated circuit or other logic device formed using one or more semiconductors. The hardware elements 1110 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 1106 is illustrated as including memory/storage 1112. The memory/storage 1112 represents memory/storage capacity associated with one or more computer-readable media. The memory/storage component 1112 may include volatile media (such as random access memory (RAM)) and/or nonvolatile media (such as read only memory (ROM), Flash memory, optical disks, magnetic disks, and so forth). The memory/storage component 1112 may include fixed media (e.g., RAM, ROM, a fixed hard drive, and so on) as well as removable media (e.g., Flash memory, a removable hard drive, an optical disc, and so forth). The computer-readable media 1106 may be configured in a variety of other ways as further described below.

Input/output interface(s) 1108 are representative of functionality to allow a user to enter commands and information to computing device 1102, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 1102 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 1102. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 1102, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 1110 and computer-readable media 1106 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 1110. The computing device 1102 may be configured to implement particular instructions and/or functions corresponding to the software and/or hardware modules. Accordingly, implementation of a module that is executable by the computing device 1102 as software may be achieved at least partially in hardware, e.g., through use of computer-readable storage media and/or hardware elements 1110 of the processing system 1104. The instructions and/or functions may be executable/operable by one or more articles of manufacture (for example, one or more computing devices 1102 and/or processing systems 1104) to implement techniques, modules, and examples described herein.

The techniques described herein may be supported by various configurations of the computing device 1102 and are not limited to the specific examples of the techniques described herein. This functionality may also be implemented all or in part through use of a distributed system, such as over a "cloud" 1114 via a platform 1116 as described below.

The cloud 1114 includes and/or is representative of a platform 1116 for resources 1118. The platform 1116 abstracts underlying functionality of hardware (e.g., servers) and software resources of the cloud 1114. The resources 1118 may include applications and/or data that can be utilized while computer processing is executed on servers that are remote from the computing device 1102. Resources 1118 can also include services provided over the Internet and/or through a subscriber network, such as a cellular or Wi-Fi network.

The platform 1116 may abstract resources and functions to connect the computing device 1102 with other computing devices. The platform 1116 may also serve to abstract scaling of resources to provide a corresponding level of scale to encountered demand for the resources 1118 that are implemented via the platform 1116. Accordingly, in an interconnected device embodiment, implementation of functionality described herein may be distributed throughout the system 1100. For example, the functionality may be implemented in part on the computing device 1102 as well as via the platform 1116 that abstracts the functionality of the cloud 1114.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A method comprising:

forming, by at least one computing device, a model of sound data for a time frame of the sound data, the model including a product of filters having a first plurality of filters and a second plurality of filters, the first plurality of filters modeling excitation sources describing pitch parameters, the second plurality of filters modeling a vocal tract describing timbral quality parameters, the forming including interchanging some filters between the first plurality of filters and the second plurality of filters;

learning, by the at least one computing device, activations for the product of filters based on the sound data;

expanding, by the at least one computing device, a bandwidth of the sound data by combining the activations and full-bandwidth filters of the product of filters to form a full-bandwidth sound signal; and outputting, by the at least one computing device, a result of the performing of the at least one sound processing technique including the full-bandwidth sound signal.

2. A method as described in claim 1, wherein the forming includes using a mean-field method for posterior inference.

3. A method as described in claim 1, wherein the forming includes using a variational expectation-maximization algorithm to estimate free parameters of the model.

4. A method as described in claim 1, wherein the forming includes using one or more statistical inference techniques on the sound data.

5. A method as described in claim 1, further comprising utilizing the model with a sparsity-inducing prior on the time frame of the sound data.

6. A method as described in claim 1, wherein the model is configured to model speech.

7. A method as described in claim 1, further comprising performing at least one of speaker identification, denoising, or dereverberation on the time frame of the sound data based on the model.

8. A method as described in claim 1, further comprising using the model as a learned product-of-filter prior in a probabilistic dictionary learning framework.

9. A method as described in claim 8, wherein the probabilistic dictionary learning framework involves nonnegative matrix factorization.

10. A system comprising:

at least one module implemented at least partially in hardware of at least one computing device to perform operations including learning filters for a plurality of time frames of sound data using one or more statistical inference techniques;

at least one other module implemented at least partially in hardware of the at least one computing device to perform operations including modeling each of the plurality of time frames of the sound data as a product of the learned filters having a first plurality of filters modeling excitation sources and a second plurality of filters modeling a vocal tract applied to output of the excitation sources; and at least one additional module implemented at least partially in hardware of the at least one computing device to:

learn activations for the learned filters based on the sound data;

expand a bandwidth of the sound data by combining the activations and full-bandwidth filters of the product of filters to forma full-bandwidth sound; signal and output the full-bandwidth sound signal.

11. A system as described in claim 10, wherein the one or more modules are configured to learn the filters through use of a mean-field method for posterior inference.

12. A system as described in claim 10, wherein the one or more modules are configured to learn the filters through use of a variational expectation-maximization algorithm to estimate free parameters of the model.

13. A method comprising:

learning, by at least one computing device, a dictionary prior by forming a model using one or more statistical inference techniques through interchangeable use of sources describing pitch parameters and filters describing timbral quality parameters as part of the model, the model configured as a generative model that decomposes a logarithm of audio spectra as sparse linear combinations of the filters;

processing, by the at least one computing device, sound data utilizing the dictionary prior as a part of nonnegative matrix factorization (NMF) by:

decomposing training data used to learn the model into a dictionary and an activation;

obtaining a band-limited part of the dictionary from the audio spectra;

determining a band-limited activation from the band-limited part of the dictionary; and reconstructing a full-bandwidth sound signal from a product of the dictionary and the band-limited activation; and outputting, by the at least one computing device, a result of the processing of the sound data including the full-bandwidth sound signal.

14. A method as described in claim 13, wherein the learning includes using a mean-field method for posterior inference and a variational expectation-maximization algorithm to estimate free parameters of the model.

15. A method as described in claim 13, wherein the nonnegative matrix factorization (NMF) to process sound data performs denoising.

16. A method as described in claim 13, wherein the nonnegative matrix factorization (NMF) to process sound data performs dereverberation.

17. A method as described in claim 13, wherein the learning is performed such that a one-to-one mapping is not constrained between one or more sources and filters of the sound data.

18. A method as described in claim 13, wherein the audio spectra includes spectra of speech.

19. A method as described in claim 13, wherein the model is formed automatically and without user intervention.

20. A system as described in claim 10, wherein a one-to-one mapping is not constrained between the first plurality of filters and the second plurality of filters.

* * * * *